US010658761B2

(12) United States Patent
Hügel et al.

(10) Patent No.: US 10,658,761 B2
(45) Date of Patent: May 19, 2020

(54) ADAPTER STRUCTURE WITH WAVEGUIDE CHANNELS

(71) Applicant: HUBER+SUHNER AG, Herisau (CH)

(72) Inventors: Ulf Hügel, Herisau (CH); Rafal Glogowski, Wiazowna (PL); Michael Thiel, St. Gallen (CH); Francesco Merli, St. Gallen (CH)

(73) Assignee: HUBER+SUHNER AG, Herisau (CH)

( * ) Notice: Subject to any disclaimer, the term of this patent is extended or adjusted under 35 U.S.C. 154(b) by 54 days.

(21) Appl. No.: 16/085,154

(22) PCT Filed: Mar. 15, 2017

(86) PCT No.: PCT/EP2017/056119
§ 371 (c)(1),
(2) Date: Sep. 14, 2018

(87) PCT Pub. No.: WO2017/158020
PCT Pub. Date: Sep. 21, 2017

(65) Prior Publication Data

US 2019/0081412 A1 Mar. 14, 2019

(30) Foreign Application Priority Data

Mar. 16, 2016 (CH) ..... 0359/16

(51) Int. Cl.
*H01Q 21/06* (2006.01)
*H01P 1/04* (2006.01)
(Continued)

(52) U.S. Cl.
CPC ..... *H01Q 21/064* (2013.01); *H01P 1/042* (2013.01); *H01P 1/2005* (2013.01); *H01P 5/024* (2013.01); *H01P 5/082* (2013.01)

(58) Field of Classification Search
CPC ..... H01Q 21/064; H01P 1/042; H01P 1/2005; H01P 3/123; H01P 5/024; H01P 5/082
See application file for complete search history.

(56) References Cited

U.S. PATENT DOCUMENTS 2,942,261 A 6/1960 Jones et al.
6,172,583 B1 1/2001 Niekamp et al.
(Continued)

FOREIGN PATENT DOCUMENTS

EP 2 595 239 A1 5/2013
EP 2 945 222 A1 11/2015

OTHER PUBLICATIONS

European Patent Office, English language version of the International Search Report, Form PCT/ISA/210 for International Application PCT/EP2017/056119, dated Jun. 12, 2017 (3 pages).

*Primary Examiner* — Robert Karacsony
(74) *Attorney, Agent, or Firm* — Pauley Erickson & Kottis

(57) ABSTRACT

An adapter structure for transferring an electromagnetic signal between an electronic component and an antenna, the adapter structure includes an adapter body having a base surface. The adapter structure further includes at least one ridged adapter waveguide channel, wherein the at least one adapter waveguide channel extends from the base surface into the adapter body. The adapter structure further includes an electromagnetic band gap structure with a plurality of band gap elements, wherein the band gap elements are spaced apart relative to each other, project from the base surface and have a front face spaced apart from the base surface. At least one band gap element is arranged as extension of a ridge of an associated adapter waveguide channel.

15 Claims, 8 Drawing Sheets

(51) Int. Cl.

| | |
|---|---|
| ***H01P 1/20*** | (2006.01) |
| ***H01P 5/02*** | (2006.01) |
| ***H01P 5/08*** | (2006.01) |

(56) References Cited

U.S. PATENT DOCUMENTS

| | | | |
|---|---|---|---|
| 2011/0280518 | A1 | 11/2011 | Wollack et al. |
| 2015/0194718 | A1 | 7/2015 | Kildal et al. |

ADAPTER STRUCTURE WITH WAVEGUIDE CHANNELS

TECHNICAL FIELD

The present invention lies in the field of high-frequency and waveguide technology. More particularly, it lies in the field of coupling antennas and electronic components, such as microwave semiconductor components, via waveguide channels.

BACKGROUND

In the field of high-frequency or microwave electronics, it is generally known to use waveguides rather than wired or galvanic connections for the transmission of signals between different elements, components, and assemblies. The waveguides are typically realized by tube- or channel-like elongated hollow structures with metallic sidewalls. The waveguides may, e. g. be of circular, square or rectangular cross section and may be optionally be ridged, e. g. single-ridged or double-ridged. Alternatively the waveguides may be realized in printed circuit board technology typically as substrate integrated waveguides. Alternatively, planar PCB transmission lines, e.g. microstrip, strip or coplanar waveguide lines, can be used.

An application where signals between different assemblies may be transmitted via waveguides to which reference is made in the following is the operative coupling between an electronic component, such as a microwave semiconductor component or a printed circuit board (PCB), and an antenna.

SUMMARY OF INVENTION

In a typical design, microwave coupling between a printed circuit board (PCB) and/or a microwave semiconductor component that is mounted on a printed circuit board on the one side, and a further microwave component, such as an antenna, on the other side, is carried out via a planar waveguide structure that is realized as part of the printed circuit board on which the microwave semiconductor component is mounted.

In high frequency electronics, impedance matching between the components as well as the connecting transmission lines, e. g. waveguides, is of major importance. Ideally, the impedance of all involved components would be identical, which, however, is hardly achievable in many practical applications due to various constraints. In any case, large steps in the impedance at the interface between different components respectively between components and waveguides should be avoided.

Furthermore, it is often desirable to couple high frequency components not only for the high frequency signal transmission, but to also to provide a robust and reliable mechanical coupling, favorably at the same time and with a small number of operations, respectively.

It is an overall objective to provide a waveguide transition that generally improves the state of the art regarding the coupling of high-frequency devices, such as an electronic component on the one side and an antenna on the other side. Favorably, the transition allows a compact and robust arrangement in a common, compact unit. Further favorably, impedance matching between the coupled devices is achieved.

The overall objective is achieved by the subject matter of the independent claims. Particularly favourable as well as general exemplary embodiments are defined by the subject matter of the dependent claims as well as the overall disclosure of the present documents. Particular advantages of the invention in general as well as of particular embodiments are discussed further below in context of the overall description.

In an aspect, the overall objective is achieved by an adapter structure for transferring an electromagnetic signal between an electronic component and an antenna. The adapter structure includes an adapter body having a base surface. The adapter body further includes at least one ridged adapter waveguide channel, wherein the at least one adapter waveguide channel extends from the base surface into the adapter body. The base surface is generally planar. The adapter structure further includes an electromagnetic band gap structure with a plurality of band gap elements. The band gap elements are spaced apart relative to each other, project from the base surface and have a front face spaced apart from the base surface. At least one band gap element is arranged as an extension of a ridge of an associated adapter waveguide channel.

The antenna may in particular be an array antenna. The electronic component may in particular be a microwave semiconductor component that may for example be mounted on a printed circuit board. Also a printed circuit board as such may be the electronic component.

The band gap elements may have a square, rectangular, cross-shaped, or rounded cross section (footprint) and be realized, e. g. as posts. Typically, the band gap elements are arranged in a pattern of rows and columns. Further favourably, the band gap elements are generally equally distanced respectively spaced apart along the rows and columns. The pattern may, however, have interruptions as required. Typically, the band gap elements project traverse or perpendicular from the base surface. The individual band gap elements as such are solid and do not comprise channels or openings. The term "footprint" refers to a cross section with a viewing direction traverse to the base surface. The term "lateral" refers to directions traverse to this viewing direction, i. e. tangential with the base surface.

As will become more readily apparent further below, the lateral dimensions and accordingly the footprint of the adapter body may be larger than the lateral dimensions and the footprint of the base surface. In particular, the base surface may be surrounded by a typically planar peripheral surface, with the base surface being the recess ground of a recess that extends in the adapter body from the peripheral surface. The height of the band gap elements may be such that the front faces of the band gap elements stand back behind a plane that is defined by the peripheral surface.

The single band gap elements typically have an identical height by which they project form the from the base surface. The front faces of the band gap elements lay in a common planar plane that is coplanar with the recess ground and spaced apart from the base surface by a distance that is given by the height of the band gap elements.

A band gap element being arranged as extension of a ridge of an associated adapter waveguide channel means that the corresponding band gap element is an extension of the ridge beyond the base surface. Typically, the transition between the ridge inside the adapter waveguide channel and the band gap element is smooth, which however, may not be the case in some embodiments.

The opening of an adapter waveguide channel into the base surface is referred to as component-facing channel opening. In an operational configuration, a component-facing channel opening may face and be aligned with a component waveguide coupling element of a microwave semiconductor component that is mounted as electronic component on a printed circuit board and faces the adapter, in particular its base surface surface and band gap elements. Alternatively, a component-facing channel opening may, in an operational configuration, be aligned with a PCB waveguide coupling aperture of a printed circuit board. Due to the electromagnetic band gap structure, the component-facing channel opening is spaced apart from the microwave semiconductor component with the component waveguide coupling element, or the PCB waveguide coupling aperture, respectively. Furthermore, a laterally continuous gap is present between the front faces of the band gap elements and the component waveguide coupling element or PCB waveguide coupling aperture, respectively. Between the electronic component, e. g. a microwave semiconductor component and/or a printed circuit board on the one side, and the component-facing channel opening of the adapter waveguide channel, the electromagnetic signal is electromagnetically coupled, rather than transmitted and guided via a circumferentially closed waveguide channel. The electromagnetic band gap structure is used to electromagnetically seal the connection. No direct galvanic coupling between the base surface around the component-facing channel opening on the one side and the printed circuit board or microwave semiconductor component on the other side is needed. In this way, otherwise delicate mutual alignment and contacting issues between the adapter and the printed circuit board or semiconductor waveguide component are avoided. The band gap structure improves the matching and prevents undesired electromagnetic parallel plate waveguide modes propagation traverse to the desired propagation direction. Further, the band gap structure reduces cross taking between different channels in embodiments with a plurality of adapter waveguide channels.

In an embodiment, the at least one adapter waveguide channel is double-ridged. In further embodiments, adapter waveguide channel has a different number of ridges and is, e. g. single-ridged or 4-ridge waveguide channel. The length and/or cross section of the adapter waveguide channel may be tuned for the purpose of characteristics respectively impedance matching and/or tuning the electrical length.

In an embodiment with a double-ridged adapter waveguide channel, two band gap elements are arranged as extensions of the two ridges of the at least one adapter waveguide channel. The two ridges and accordingly the two corresponding band gap elements are favourably arranged symmetric and face each other in a top view, resulting in a H-shaped cross section of the adapter waveguide channel and footprint of the component-facing channel opening. In a general, for each ridge of an adapter waveguide channel, an associated band gap element may be arranged as extension of this ridge.

In an embodiment, the adapter structure comprises a plurality of adapter waveguide channels, wherein for each of the adapter wave guide channels, at least one band gap element is arranged as extension of a ridge of the associated waveguide channel. Each of the adapter waveguide channels has an associated component-facing channel opening in the base surface, typically a single associated component-facing channel opening. The individual adapter waveguide channels are typically structurally distinct and electromagnetic separate from each other, i.e. are not interconnected by way of waveguide channels or otherwise operatively coupled. The individual adapter waveguide channels may or may not be branched within the adapter body.

In some embodiments with a plurality of adapter waveguide channels, the adapter waveguide channels are arranged such that their associated component-facing channel openings are arranged on the base surface along a straight line and are, for example, equally spaced with respect to each other. Other arrangements, however, may be used in particular with the specific circumstances of the application.

In some embodiments with a plurality of adapter waveguide channels, the adapter waveguide channels of the plurality of adapter waveguide channels are of substantially identical electrical length.

In some embodiments with a plurality of adapter waveguide channel, each of the adapter waveguide channels is double ridged. For each of the adapter waveguide channels, two band gap elements may be arranged as extensions of the two ridges of this adapter waveguide channel. Each of the component-facing channel openings may accordingly be H-shaped as explained above.

In some embodiments with a plurality of adapter waveguide channels, the plurality of adapter waveguide channels forms a distribution structure. In many cases, the single component waveguide coupling elements of a microwave semiconductor component or the PCB waveguide coupling apertures are arranged closer to each other and/or in different geometric pattern as compared to their counterparts, in particular, antenna waveguide coupling openings of an antenna. The adapter waveguide channels, in particular curved adapter waveguide channels may be arranged to serve as transition elements for the geometric matching. In particular in embodiments where the adapter formed integrally with an antenna respectively is integral part of antenna as discussed further below, adapter waveguide channels may be branched within the adapter body, thereby operatively connecting a component/PCB-facing channel opening with a plurality of electromagnetic signal transmitting and/or receiving elements of the antenna, thereby serving as part of a waveguide signal distribution structure.

In an embodiment, at least one adapter waveguide channel is curved. An adapter waveguide channel may be curved in a plane and/or may be spatially (three-dimensionally) curved. A curved adapter waveguide channel allows the compensation respectively bridging of a lateral displacements between opposite sides of the adapter structure. This kind of embodiment is particularly favourably in the context of a distribution structure as explained before. In an embodiment, the at least one adapter waveguide channel has at least one straight and at least one curved section. In embodiments with a plurality of adapter waveguide channels, some or all of them may be curved. Generally, an adapter waveguide extends from the base surface normal respectively perpendicular to the base surface.

In an embodiment, all band gap elements are of identical footprint. In alternative embodiments, band gap elements of different footprints. In particular, band gap elements that are extensions of waveguide ridges may have a different footprint than other band gap elements. The terms "lateral" refers to directions tangential to the base surface, perpendicular to a normal.

In an embodiment, a plurality of component-facing channel openings is arranged along a line as explained before and the band gap elements are arranged in a matrix of rows and columns. The line of component-facing channel openings may for example be parallel to the rows of band gap elements. Each of the component-facing channel openings may arranged in line with a different column of band gap elements. In an example, a component-facing channel opening is arranged in every second column, with one or more, column(s) of band gap elements between them. The line along which the component-facing waveguide openings are arranged is favourably centric with respect two adjacent rows of band gap elements, such that every e.g. second band gap element of these two rows form an extension of a channel ridge. For each adapter waveguide channel and component-facing channel opening, the band gap elements of the same column and in the two adjacent rows form the extensions of the waveguide ridges. It is noted that the role of rows and columns is generally interchangeable.

In an embodiment, the adapter structure is made from plastics, in particular injection-moulded plastics. A manufacture from injection-moulded plastics is favourable in view of cost efficient manufacture with established and proven technology. Other advanced technologies, such as 3D-printing or stereo lithography may be used as well. Typically, the adapter structure is made from a single piece of material, with the adapter body and the band gap elements of the electromagnetic band gap structure being formed in an integral way. As will be explained further below, the adapter structure may also be an integral part of another device, in particular an antenna. In principle, the adapter structure may also be formed from a piece of metal by way of machining.

As explained before, at least the surfaces of the adapter structure that are functionally relevant for the microwave signal transmission and the inner walls of the adapter waveguide channel are galvanic conductive. Therefore, at least these surfaces may be metalized, e.g. by metal coating or metal plating as generally known in the art. In particular the inner surfaces of the adapter waveguide channel(s), the base surface between the band gap elements, as well as the front faces and circumferential or shell surfaces of the band gap elements are metallized, thereby forming a common galvanic surface. Typically, also circumferential or sell surfaces of the adapter body are metallized and part of the common galvanic surface. For ease of manufacture, the whole adapter structure surface may be metalized. If the adapter structure is made from metal as inherently conductive material by machining, no particular metal coating may be required, but can be optionally present.

In an embodiment, the adapter structure includes a PCB alignment structure for mutually aligning the adapter structure with a printed circuit board and/or an antenna alignment structure for mutually aligning the adapter structure with the antenna. Exemplary suited embodiments of alignment structures are disclosed further below. The alignment structure in particular ensures correct relative positioning of the adapter to the antenna and/or the printed circuit board as required for correct operative coupling of the at least one adapter waveguide channel.

In an embodiment, the base surface is, in the area of the electromagnetic band gap structure, planar with exception of the band gap elements. The band gap elements are accordingly the only elements that protrude beyond the plane that defines the base surface. Adapter waveguide channels do not extent within band gap elements.

In an embodiment, the adapter structure is an adapter device for transferring a microwave signal between a component waveguide coupling structure of an electronic component, in particular a microwave semiconductor component mounted on a printed circuit board (PCB), and an antenna waveguide coupling structure of the antenna. For this type of embodiment, the adapter structure or adapter device further includes an antenna-facing adapter surface and an antenna-opposing adapter surface. The antenna-opposing adapter surface is spaced apart from the antenna-facing adapter surface. The antenna-opposing adapter surface has a component-receiving recess. The component-receiving recess is dimensioned to receive at least part of the microwave semiconductor component. The component-receiving recess further has a recess ground that defines the base surface. The at least one adapter waveguide channel extends in the adapter body between the recess ground and the antenna-facing adapter surface. The antenna-facing adapter surface and the antenna-opposing adapter surface are outer surfaces of the adapter body. The at least one adapter waveguide channel extends inside the adapter body between the base surface and the antenna-facing waveguide channel.

The adapter device may be a dedicated device that is structurally distinct from the printed circuit board and the antenna and is designed for arrangement in between them, with the antenna-facing adapter surface being designed for mounting to and coupling with a bottom surface of an antenna, in particular an array antenna. The antenna-opposing adapter surface may, for example, be designed for mounting to and coupling with a printed circuit board. In an operational configuration, a microwave semiconductor component that is mounted on the printed circuit board such that a component waveguide coupling element of the microwave semiconductor component is aligned with a component-facing channel opening of an associated adapter waveguide channel and thereby operatively couples to the adapter waveguide channel. The electromagnetic band gap structure is arranged between the semiconductor waveguide component and base surface with the component-facing channel opening, such that the electromagnetic coupling is via the electromagnetic band gap structure. Further, a gap is present between the front faces of the band gap elements and the microwave semiconductor component. The gap is favourably in a range of 1/10th and 1/200th of the wavelength for a mid-frequency for which the design is optimized.

The adapter device may be produced from a single piece of material that also forms the adapter body and is typically made from metallized injection moulded plastics, but may also be made from other metal materials by way of machining. Typically, the antenna-facing adapter surface, the antenna-opposing adapter surface and the base surface are coplanar and the plane defining the base surface is between the antenna-facing adapter-surface and the antenna-opposing adapter surface.

This type of embodiment of an adapter structure that is realized as dedicated adapter device is particularly favourable for coupling a printed circuit board and an antenna in a reliable and robust manner, both from the high-frequency and the mechanical point of view.

In an embodiment, a PCB mounting structure is on the antenna-opposing adapter surface.

According to a further aspect, the overall objective is achieved by an antenna, in particular an array antenna. The antenna comprises an adapter according to the present disclosure. The antenna has a top surface with at least one waveguide opening for transmitting and/or receiving electromagnetic signals. The at least one waveguide opening is operatively connected with the at least one adapter waveguide channel. Typically, the top surface is generally planar. Typically, the base surface of the adapter is coplanar with the top surface.

The at least one waveguide opening serves as transmitting and/or receiving element as generally known. In a typical embodiment, a plurality of waveguide openings is present that may, e.g. be arranged in a pattern of rows or columns.

In an embodiment, the antenna is made by a stack of coplanar layers, having a top layer, optionally one or more intermediate layers and a bottom layer. The top surface is the outer surface of the top layer. The bottom layer is formed by the adapter body. The at least one adapter waveguide channel extends in the base layer from the component-facing channel opening in the base surface to the top surface of the bottom layer. The adapter waveguide channel or adapter waveguide channels may extend in an unbranched and straight or curved way inside the bottom layer to the opposite top surface of the bottom layer where they operatively couple with the waveguide channels or waveguide openings of top next layer, e. g. the top layer or an intermediate layer. Alternatively, the top surface of the bottom layer may be corrugated, thereby forming part of waveguide distribution network. For such embodiments, waveguide channels are formed, in combination, by the corrugations in the top surface of the bottom layer and matching or associated corrugations in the bottom surface of the next following layer. Further parts of the waveguide distribution network may be realized as part of intermediate layers and/or the top layer. The top and bottom surfaces of all layers, including in particular the top surface of the bottom layer or adapter body, are generally metalized. Typically, all layers are of the same size and have identical footprint.

The footprint of the antenna layers and in particular of the bottom layer respectively adapter body is typically larger than of the of electromagnetic band gap structure with the component-facing channel openings. The base surface from which the band gap elements project is therefore surround by a peripheral surface that is coplanar with the base surface. The bottom layer is accordingly the recess ground of a recess that extends from a plane defined by the peripheral surface. The height of the band gap elements is such that their front faces are coplanar with but stand behind the peripheral surface. A plane defined by the front faces of the band gap elements stands accordingly back behind the plane defined by the peripheral surface, with a continuous room in between them. The peripheral surface is at the same time a mounting surface via which the antenna is connected with a printed circuit board in an operational configuration.

An antenna with an integrated adapter structure according to the present disclosure can be directly coupled to a printed circuit board in a reliable and robust manner, both from the high-frequency and the mechanical point of view.

According to a further aspect, a printed circuit board (PCB) is disclosed. The printed circuit board comprises a stack of coplanar layers. The coplanar layers comprise dielectric layers that are separated by prepreg layers. Suited materials for the dielectric layers and the prepreg layers are, for example, Isola Astra MT77 or Tachyon 100G with corresponding prepregs, Rogers Ro3003 with corresponding prepreg, or Taconic TSM-D3/EZ-IO with Fastrise prepreg. A least one substrate-integrated waveguide (SIW) is integrated into the printed circuit board. The at least one SIW includes a first SIW section that passes into an associated second SIW section that is wider than the first SIW section. The at last one SIW with its first SIW section and second SIW section is at its sides (traverse to the direction of wave propagation) delimited by an arrangement of through-going vias that bridge all layers of the printed circuit board. In direction of the wave propagation, the second SIW section is delimited by an arrangement of through-going vias traverse to the direction wave propagation, resulting in an U-shape of the second SIW section. The two outermost layers of the printed circuit board are dielectric layers. The outer surfaces of the outermost layers form an antenna-facing PCB surface and an antenna-opposing PCB-surface, respectively. In a typical arrangement, a plurality of SIWs, each having a first SIW section and a second SIW section as explained before, is present in a side-by-side arrangement. The single SIWs are operatively decoupled from each other by way of through-going vias. In a typical embodiment, the printed circuit board may comprise three dielectric layers and two prepreg layers. While a printed circuit board according to the here-described design is favorable in combination with an adapter structure and an antenna according to the present document, it may also be used in further high-frequency application.

The antenna-opposing surface has a metallization in the area of the SIW sections, i.e. in the areas from which the through-going vias extend and in-between through-going vias of each SIW section. The antenna-facing PCB surface is metallized in its functionally relevant area, that is galvanic connected with the metallization on the antenna-opposing PCB surface by way of the through-going vias. For each SIW, the antenna-facing PCB surface has a metallization which is partially removed to form at least one PCB waveguide coupling aperture that may in particular be H-shaped. The inner dielectric layers are generally non-metalized in the functionally relevant area, e.g. inside SIW sections.

The printed circuit board further includes, for each second SIW section, a blind via. The blind via extends from the metallization in the antenna-opposing PCB surface into the printed circuit board. A blind via ends within the PCB on the antenna-facing surface of an inner dielectric layer, for example the second dielectric layer when viewed from the antenna-facing PCB-surface, i. e. the middle dielectric layer in case of three dielectric layers.

It is noted that a total number of three dielectric layers and two prepreg layers is exemplary and not essential. In particular, a design with more layers may in principle be used. Also, the layer where the blind vias end may be varied. For good performance, however, the blind vias should favourably end as close to the antenna-facing PCB surface as possible.

By way of a metallic connection strip (typically non-removed metallization of the dielectric layer as mentioned before) the blind end of a blind via is galvanic connected with an associated through-going via. In an embodiment, the connection strip runs parallel to the extension direction of the second SIW section (direction of wave propagation) and connects the blind end of the blind via with a neighboring through-going via of the arrangement of through-going vias traverse to the direction of wave propagation.

A blind via is laterally positioned relative to the associated PCB waveguide coupling aperture such that its center is aligned with the center of second SIW section respectively the PCB waveguide coupling aperture in the direction of the width of the waveguide apertures (traverse to the direction of wave propagation). In direction of the wave propagation, half of the blind via lies within the area of the PCB waveguide coupling aperture while the other half lies under the metallization of the antenna-facing PCB surface, towards the side of the through-going vias that delimit the second SIW section traverse to the direction of wave propagation.

The arrangement of blind vias and waveguide-coupling openings forms a waveguide coupling structure that deflect the electromagnetic waves from a wave propagation that is tangential to the printed circuit board by 90 degrees such that they enter and/or exit the PCB waveguide coupling apertures traverse to the printed circuit board. Further, the arrangement serves for impedance matching between the SIW waveguides and the adapter waveguide channels of an adapter structure as explained before. In an operational configuration, the printed circuit board and the adapter structure are arranged such that each PCB waveguide coupling aperture is aligned with a corresponding component-facing channel opening and adapter waveguide channel.

Further aspects of exemplary embodiments for this type of printed circuit board are discussed further below in the context of exemplary embodiments.

In a still further aspect, the overall objective is achieved by a microwave assembly. The microwave assembly includes an antenna with an adapter structure, and a printed circuit board (PCB). The printed circuit board has an antenna-facing PCB surface with at least one PCB waveguide coupling aperture. The front faces of the band gap elements face an antenna-facing PCB surface. The at least one PCB waveguide coupling aperture is aligned and operatively connected with the at least one adapter waveguide channel. In some embodiments, the printed circuit board has a plurality of PCB waveguide coupling apertures, each of which are operatively connected with an associated adapter waveguide channel. In some embodiments, the printed circuit board is a printed circuit board with a waveguide coupling structure as explained before and/or further below in the context of exemplary embodiments.

In a still further aspect, the overall objective is achieved by a method for transmitting at least one electromagnetic signal, in particular a microwave signal, the method including transmitting the at least one electromagnetic signal via an adapter structure, an antenna, and/or a microwave assembly as discussed above and/or further below in the context of exemplary embodiments.

According to a further aspect, the overall objective is achieved by an adapter device. The adapter device is designed for transferring a microwave signal between a component waveguide coupling structure of a microwave semiconductor component mounted on a printed circuit board (PCB) and an antenna waveguide coupling structure of an antenna. The adapter device includes an antenna-facing adapter surface and an antenna-opposing adapter surface, the antenna-opposing adapter surface being spaced apart from the antenna-facing adapter surface. The antenna-opposing adapter surface has a component-receiving recess. The component-receiving recess is dimensioned to receive at least part of the microwave semiconductor component. The component-receiving recess has a recess ground. The adapter device further includes at least one adapter waveguide channel. The at least one adapter waveguide channel is a ridged waveguide channel and extends inside the adapter device between the recess ground and the antenna-facing adapter surface. In some embodiments, the ridged waveguide channel is a single-ridged waveguide (SRWG) channel. The adapter device further includes a printed circuit board mounting structure on the antenna-opposing adapter surface for mounting the printed circuit board to the adapter device. The at least one adapter waveguide channel being single-ridged results in a U-shaped cross section. In case of a double-ridged adapter waveguide channel the cross section is H-shaped. In a typical embodiment with a number of adapter waveguide channels, each of the adapter waveguide channel is typically ridged and the single adapter waveguide channels are typically of the general type of design, but may have different dimensions. In embodiments with a plurality of adapter waveguide channels as discussed further below in more detail, a reference to the at least one adapter waveguide channel and/or to an element that is associated with the at least one adapter waveguide channel is generally to be understood as reference to each of the adapter waveguide channels respectively associated elements. The adapter device may be an adapter structure as described before, with the body of the adapter device being the adapter body. It is noted that the antenna-opposing adapter surface is referred to as antenna-adjacent adapter surface in the priority-founding application CH-00359/16. However, since this surface is on the opposite side of the adapter as compared to the antenna, it is referred to as antenna-opposing adapter surface throughout this document.

As discussed in more detail further below, the component waveguide coupling structure includes or is made from at least one component waveguide coupling element. The antenna waveguide coupling structure includes or is made from at least one antenna waveguide coupling opening.

The component-receiving recess may, in addition to the microwave semiconductor component, receive further components that are mounted on a printed circuited board and the adapter device may simultaneously serve as housing or enclosure for the components.

On the antenna-facing side, the at least one adapter waveguide channel opens into an antenna-facing channel opening in the antenna-facing adapter surface. Similarly, each of the at least one adapter waveguide channel opens into a component-facing channel opening. The component-facing channel opening is arranged in the component-facing recess or a component-facing end of a channel post as explained further below.

Favourably, the recess ground is planar. It may further be coplanar with the antenna-facing adapter surface and/or antenna-opposing adapter surface.

The adapter device is, at least in the functionally relevant areas of the antenna-opposing adapter surface and the antenna-facing adapter surface conductive. Likewise, the wall surfaces of the adapter waveguide channel or adapter waveguide channels are conductive and galvanic coupled with the antenna-opposing adapter surface and the antenna-facing adapter surface respectively their conductive parts, thus forming a common conductive surface.

In an assembled state, the antenna-facing channel opening is aligned with a corresponding antenna waveguide coupling opening of the antenna for microwave signal transmission. Similarly, in the assembled state, the component-facing channel opening is aligned with a corresponding component waveguide coupling element of the microwave semiconductor component for microwave signal transmission. Typically, the adapter waveguide channel does not have branches and establishes a one-to-one respectively point-to point microwave coupling between each component waveguide coupling element and a corresponding antenna waveguide coupling opening.

In addition to the general high-frequency waveguide coupling of antenna and microwave semiconductor component, the adapter waveguide channels specifically provide an impedance matching between component waveguide coupling elements on the one hand and waveguide channels of the antenna on the other hand. The design and course of each adapter waveguide channel may be numerically computed for a given semiconductor component respectively antenna waveguide coupling opening and antenna design. It is noted that the term "matching" does, in the context of the present disclosure, not necessarily imply an ideal matching in a strict mathematical sense, but a matching that is suited for the required signal transmission between antenna and PCB/semiconductor component.

The adapter waveguide channel or adapter waveguide channels being ridged, for example single-ridged, has the particular advantage of reducing the size. Typically, the adapter waveguide channel is single-ridged. Ridged adapter channel waveguides allow to place significant more transition in the same chip package area as compared to rectangular waveguide, which is of particular advantage in MIMO applications. A further desirable effect of the ridged waveguide channel is a larger bandwidth as compared to rectangular waveguide channels. In a classic design with planar waveguide structure as part of the printed circuit board, an expensive low loss PCB fan-out structure would be required to achieve sufficient spacing.

An adapter device in accordance with the present disclosure may be used in a variety of different applications. Particular advantages are achieved in the context of multiple-input and multiple-output (MIMO) radio applications to which particular reference is made in the following.

In an embodiment of the adapter device, the at least one adapter waveguide channel is curved. The adapter waveguide channel may be curved in a plane and/or spatially (three-dimensionally) curved. A curved adapter waveguide channel allows the compensation respectively bridging of a lateral displacement between a component waveguide coupling element and the corresponding antenna waveguide coupling openings if they are not aligned. This kind of embodiment is particularly favourably in the context of a distribution structure as explained further below. In some embodiments, the at least one adapter waveguide channel has at least one straight and at least one curved section.

A section of the adapter waveguide channel may be open to the antenna-facing adapter surface and run continuously into the antenna-facing channel opening, with the antenna-facing channel opening forming an end of the open antenna waveguide channel section and being integral therewith. In such case the bottom (adapter plate facing) antenna surface is forming the top wall of the channel.

In an embodiment of the adapter device, the adapter device includes an electromagnetic band gap structure with a plurality of band gap elements, the band gap elements being spaced apart relative from each other and projecting from the recess ground into the component-receiving recess. The component-facing channel openings are arranged between the band gap elements. A band gap structure favourably improves the matching and prevents parallel plate mode wave propagation despite the lack of direct galvanic coupling respectively contact around component-facing waveguide channel openings. Furthermore, a band gap structure reduces cross taking between different channels in embodiments with a plurality of adapter waveguide channels.

In an embodiment, the band gap elements are posts of square cross section.

In an embodiment, the band gap elements are arranged in a pattern of rows and columns. Favourably, the band gap elements are generally equally distanced along the rows and columns. The pattern may, however, be interrupted for the component-facing channel openings.

The single band gap elements have an identical height by which they project from the planar recess ground into the component-receiving recess. The component facing ends respectively end surfaces of the band gap elements lay in a common planar plane that is coplanar with the recess ground.

In an embodiment of the adapter device, a corresponding channel post is associated with the at least one adapter waveguide channel or each of a plurality of adapter waveguide channels. The channel post projects from the recess ground into the component-receiving recess. The waveguide channel extends through the channel post and opens into a component-facing end respectively end surface of the channel post. The channel posts project from the planar recess ground by a common height which is favourably identical with the height of the band gap elements as explained before. The component-facing ends respectively end surfaces of the channel posts accordingly lay in the same plane as the component facing ends respectively ends surfaces of the band gap elements. In embodiments with channel posts, the component-facing channel openings are arranged in the component-facing ends respectively end surfaces of the channel posts. Within the channel post, the adapter waveguide channel may be straight and in e.g. parallel alignment with the adapter channel post.

In an embodiment of the adapter device, the adapter device is made from plastics, in particular injection-moulded plastics. A manufacture from injection-moulded plastics is favourable in view of cost efficient manufacture with established and proven technology. Other advanced technologies, such as 3D-printing or stereo lithography may be used as well additionally or alternatively.

As explained before, at least the surfaces of the adapter device that are functionally relevant for the microwave signal transmission and the inner walls of the adapter waveguide channel are galvanic conductive. Therefore, at least these surfaces may be metalized, e. g. by metal coating or metal plating as generally known in the art. For ease of manufacture, the whole adapter device surface including the adapter waveguide channels may be metalized. In principle, the adapter device may also be made from metal as inherently conductive material by machining.

In an embodiment of the adapter device, the antenna-facing adapter surface and the component-facing adapter surface (antenna-opposing adapter surface) are coplanar planes. This type of embodiment defines the typical plate-shaped design of the adapter device. Local exceptions may be present on either or both of the antenna-facing and the antenna-opposing adapter surface in from of projections, recesses, ridges, or the like, thus deviating from a strictly planar surface geometry. The recess ground is favourably a plane and coplanar with the antenna-facing adapter surface and the antenna-opposing adapter surface.

The component facing ends respectively end surfaces of band gap elements and/or channel posts, if present, may also lay in a common plane that is coplanar with the before-mentioned surfaces, but are typically recessed respectively set back with respect to the antenna-opposing adapter surface and fully within the component-receiving recess. In alternative embodiments, the surfaces are each substantially planar, but not coplanar, but angled.

In an embodiment of the adapter device, the adapter device includes a plurality of separate adapter waveguide channels. This is the typical kind of embodiment e g. for the coupling between a microwave semiconductor component and an array antenna. A one-to-one coupling is provided by each of the adapter waveguide channels between a component waveguide coupling element and a corresponding antenna waveguide coupling opening for signal transmission.

In an embodiment, the adapter waveguide channels are of substantially identical electrical length.

In an embodiment of the adapter device, the plurality of adapter waveguide channels forms a distribution structure. In many cases, the single component waveguide coupling elements are arranged closer to each other and/or in different geometric pattern as compared to the antenna waveguide coupling openings to the antenna. In an exemplary arrangement, the antenna waveguide coupling openings and accordingly the antenna-facing channel openings of the adapter device are arranged in a row and e. g. equally spaced with respect to each other, and/or in a matrix of multiple rows and columns. The component waveguide coupling elements and accordingly the component-facing channel openings are arranged in a different geometric pattern that is determined by the microwave semiconductor component design. The geometric matching is done by the adapter waveguide channels.

In an embodiment adapter device, the printed circuit board interface structure and the component-receiving recess are designed such that, in an assembled state, a gap is present between the microwave semiconductor component, in particular the at least one component waveguide coupling element of the microwave semiconductor component, and a component-facing channel opening of the at least one adapter waveguide channel respectively the adapter waveguide channels. The gap is favourably in a range of 1/10th and 1/200th of the wavelength for the mid-frequency for which the design is optimized. From a microwave transmission point of view, a direct contact between the component waveguide coupling element and the corresponding component-facing channel opening would be ideal. Such design, however, is critical with respect to mechanical alignment and tolerances and further unfavourable in view of typically different coefficients of thermal expansions. Also, the microwave semiconductor component and the adapter device are mechanically decoupled and mechanical stress is avoided. Therefore, a small gap may be favourable from a practical point of view. The gap may be equal to or smaller than 500, 400, 300, 200, 100, 50, or 20 Micrometers.

In an embodiment with band gap elements and/or channel posts as explained before, a gap is be present between the component-facing ends respectively end surfaces of the band gap elements and/or channel posts on the one hand and an adjacent surface of the microwave semiconductor component. The gap may be equal to or smaller than 500, 400, 300, 200, 100, 50, or 20 Micrometers.

In an embodiment of the adapter device, the adapter device includes a dielectric coupling member, the coupling member being arranged in the component-receiving recess. The coupling member is "transparent" for electromagnetic waves in the relevant frequency range. Such coupling member may be, e.g. made from Kapton (polyimide) or Teflon (ptfe). The coupling member may be realized as dielectric coupling sheet, coupling foil or coupling film with coplanar surfaces, respectively of constant thickness and bridge the before-mentioned gap. The coupling member have a sheet-like shape and a small thickness as compared to its lateral dimensions. The coupling member may have a footprint that corresponds to the footprint of the component-receiving recess and spans the total or substantially total area of the component receiving recess when viewed from the component side. Providing such coupling member is favourable to ensure a uniform distance between component waveguide coupling elements and corresponding component-facing channel openings. In a variant, the coupling member is not made from a foil or the like as explained before, but is realized as injection-molded disk. In such embodiments the coupling member may have, at its component-facing surface, an alignment structure for alignment of the microwave semiconductor component relative to the adapter waveguide channels of the adapter device. The alignment structure may, for example, be realized by an alignment recess in the component-facing surface of the coupling member, with the contour respectively footprint of the alignment recess fitting to the contour respectively footprint of the microwave semiconductor component and receiving the microwave semiconductor component with tight tolerance. Alternatively to an alignment recess, positive alignment elements, such as component alignment posts may be present and project from the component-facing surface of the coupling member for aligning the microwave semiconductor component.

The printed circuit board mounting structure may be realized by or include a favourably planar printed circuit board coupling surface that contacts, in an assembled state, a corresponding counter-surface of the printed circuit board. The printed circuit board coupling surface is favourably coplanar with the antenna facing adapter surface, such that the printed circuited board is, in an assembled state, parallel to the antenna facing adapter surface and the recess ground. The printed surface coupling surface may circumferentially surround the component-receiving recess. The printed circuit board mounting structure may further include attachment for rigid attachment of the printed circuit board, such as threaded bores for receiving machine screws or threadless bores for receiving a threaded section of self-cutting screws. The printed circuit board may have corresponding throughholes. Alternatively, the printed circuit board and the adapter device may be connected via snap-fit elements or adhesive bonding.

The adapter device may further include an alignment structure for mutually aligning the adapter device with the antenna and/or the printed circuit board. By way of example, a printed circuit board alignment structures realized by a circumferential alignment ridge that surrounds the printed circuit board coupling surface and the component-receiving recess. The footprint of the enclosed area that is delimited by the alignment ridge, when viewed from the printed circuit board side, corresponds to the footprint o the printed circuit board such that the alignment ridge and printed circuit board fit with sufficiently tight tolerance for microwave signal coupling, with the alignment ridge surrounding the printed circuit board. In alternative embodiments, a number of separate alignment ridges, alignment posts, alignment pins, or the like is provided for lateral positioning rather than a closed circumferential ridge. A printed circuit board may also be realized by bore-pin-pairs, or the like. Via an alignment ridge or similar elements, the printed circuit board is positioned respectively aligned as a hole. Alternatively, the microwave semiconductor component may be aligned via an alignment structure of a coupling member as explained before.

An antenna alignment structure is exemplarily realized by a number of alignment recesses or alignment cut-outs that is arranged along the circumference of the plate-shaped adapter device and serves for alignment with the antenna via corresponding alignment pins and corresponding alignment recesses or alignment cut-outs of the antenna. Other antenna alignment structures, such as matching pairs of alignment posts and corresponding alignment recesses on the antenna-facing adapter surface and an adapter-facing antenna surface may also be provided.

According to a further aspect, the overall objective is achieved by an antenna assembly. The antenna assembly includes an antenna, in particular an array antenna. The antenna has an adapter-facing antenna surface that has an antenna waveguide coupling structure with at least one antenna waveguide coupling opening. The antenna assembly further includes an adapter device as described above and/or further below. The adapter-facing antenna-surface and the antenna-facing adapter surface are coupled such that the at least one adapter waveguide channel operatively couples with a corresponding antenna waveguide coupling opening for microwave signal transmission. For this purpose, the at least one antenna-facing channel opening is aligned with a corresponding antenna waveguide coupling opening.

The antenna may have adjacent coplanar outer surfaces, with one of the outer surfaces being the adapter-facing antenna surface and having the waveguide coupling structure with the at least one antenna waveguide coupling opening. The other outer surface has waveguide openings, e. g. horn-shaped waveguide openings for transmitting and/or receiving electromagnetic waves. The antenna may be realized as a stack of coplanar layers.

The adapter-facing antenna surface and the antenna-facing adapter surface are favourably in a real galvanic contact and each antenna-facing channel opening and the corresponding antenna waveguide coupling opening are aligned with respect to each other and lay in a common plane without a gap.

The adapter device and the antenna may be of equal footprint and may be permanently and rigidly attached to each other e. g. via adhesive bonding or soldering, thus forming a compact stack of coplanar layers. They can be also screwed together with a set of screws.

According to a further aspect, the overall objective is achieved by a microwave assembly. The microwave assembly includes a printed circuit board with a microwave semiconductor component mounted on the printed circuit board. The microwave semiconductor component has a component waveguide coupling structure with at least one component waveguide coupling element. The microwave assembly further includes an adapter device and/or an antenna assembly according as described above and/or further below. The printed circuited board and the adapter device are coupled such that the microwave semiconductor component projects from the printed circuit board into the component-receiving recess and each adapter waveguide channel operatively couples with a corresponding component waveguide coupling element for microwave signal transmission. A microwave assembly and in particular an adapter in accordance with the present disclosure may be used in a wide frequency range of typically 35 GHz to 100 GHz, for example at 60 GHz or 77 GHz.

The printed circuit board may be connected to and aligned with the adapter device as explained before. Since the printed circuit board is not involved in the microwave signal transmission, it may be of comparatively cheap material, e. g. FR4.

In some embodiments, more than one microwave semiconductor component, with one or more of them having a component waveguide coupling structure, and/or further electronics component, can be used.

The microwave semiconductor component includes a microwave semiconductor chip. The component waveguide coupling element may also be referred to as transformer element and is configured to transform a microwave signal from the microwave semiconductor chip into a microwave waveguide signal that is fed into an adapter waveguide channel and/or a microwave signal that is received via an adapter waveguide channel into a microwave signal for the microwave semiconductor chip. The component waveguide coupling elements and adapter waveguide channels are in a one-to-one relationship and an adapter waveguide channel is present for each component waveguide coupling element.

The component waveguide coupling element may, for example, be realised as launcher, an on-chip antenna or an off-chip antenna as described, e. g. in US 2016043455 A1, potentially slightly adapted from a rectangular waveguide to a single ridged waveguide launcher. The semiconductor further includes an encapsulating material forming an encapsulant which embeds the microwave semiconductor chip with methods and encapsulates as known in the art. By way of example, the microwave semiconductor component is realized as embedded waver level package (eWLP).

Electrical coupling of the microwave semiconductor component and in particular the microwave semiconductor chip to the printed circuit board may be realized according to a variety of technologies as generally known in the art. By way of example, the microwave semiconductor component is realized as eWLB (embedded wafer level ball grid array) as a specific type of an eWLP package. Reference is made to US 2016043455 A1 in the context of microwave semiconductor chip design.

BRIEF DESCRIPTION OF FIGURES

FIG. 10A, 10B show cross sectional views from FIG. 10;

EXEMPLARY EMBODIMENTS

In the following description of exemplary embodiments, directional terms such as "top", "bottom", "left", "right", are referred to with respect to the viewing directions according to the drawings and are only given to improve the reader's understanding. They do not refer to any particular directions or orientations in use. In particular, "top" and "bottom" refer to the z-axis as indicated in the figures. Further, the coordinate system that is shown in some figures is provided only for purposes of explanation and clarity only and does not imply any limitations to the generality.

The antenna, the adapter plate and the printed circuit board are stacked in z-direction with footprints being defined traverse to the z-direction where not stated differently. The directions traverse to the z-direction are also referred to as lateral directions. The antenna is the bottom most and the printed circuit board the top-most component.

Figure 1:
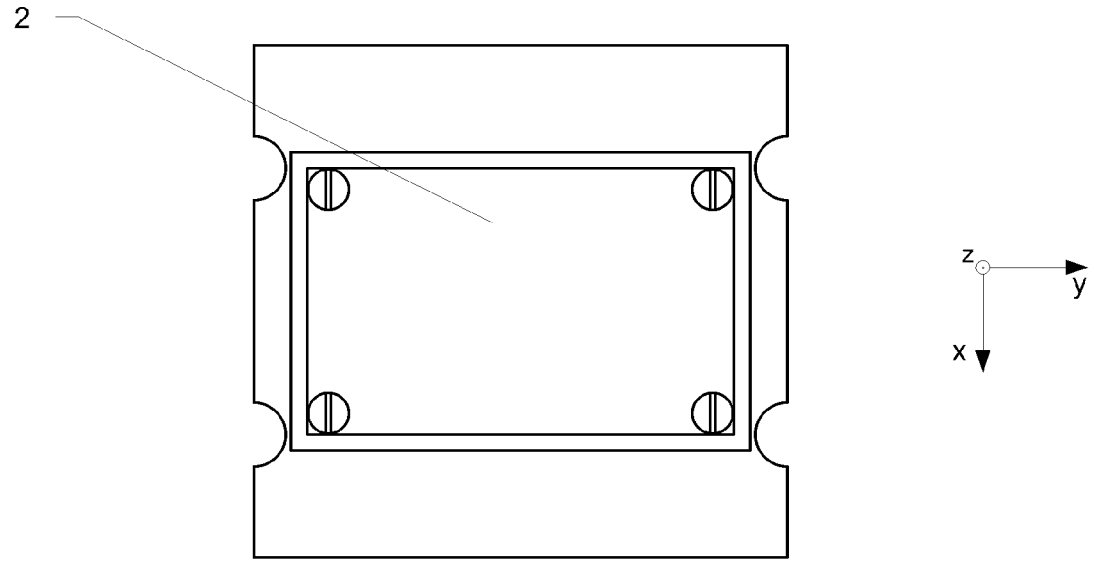
FIG. 1 shows a microwave assembly in a top view.
Figure 2:
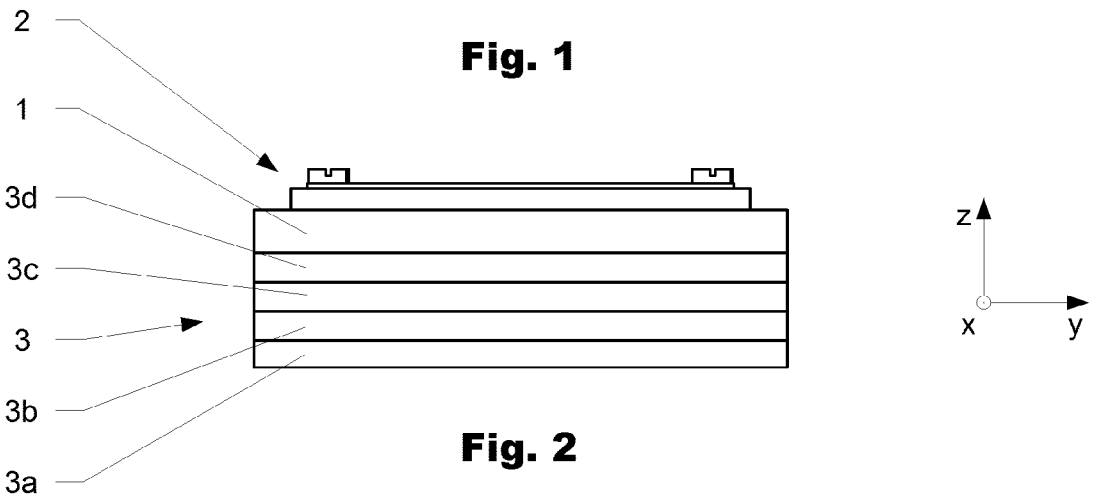
FIG. 2 shows the microwave assembly in a side view.
Figure 3:
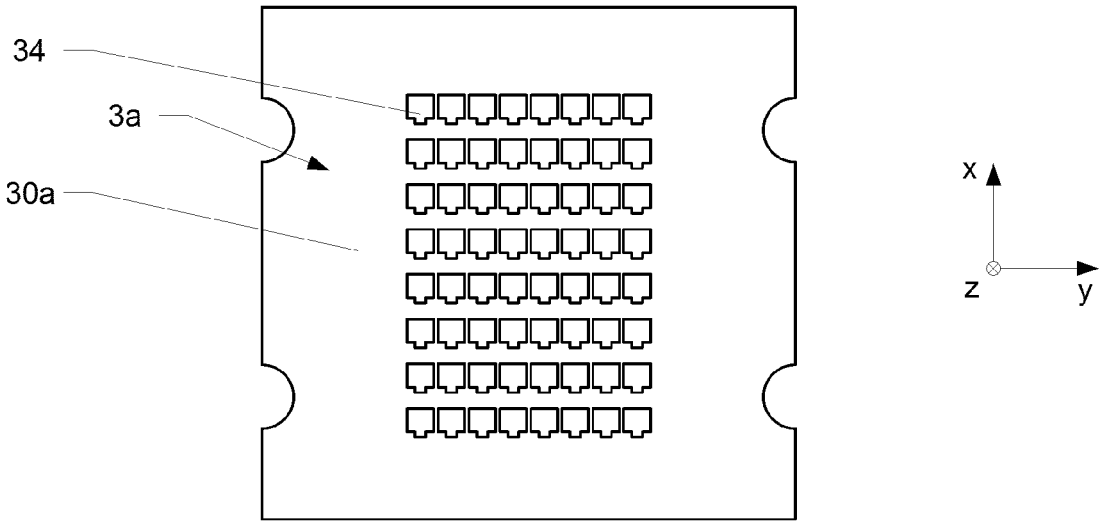
FIG. 3 shows the microwave assembly in a bottom.

In the following, reference is first made to FIG. 1 to FIG. 3. FIG. 1 shows an exemplary microwave assembly in accordance with the present disclosure in top view; FIG. 2 shows the microwave assembly in a side view; FIG. 3 shows the microwave assembly in bottom view.

The microwave assembly includes an adapter device 1, a printed circuit board 2 with at least one microwave semiconductor component (the latter being hidden in FIG. 1 to FIG. 3), and an array antenna 3 in a mounted state. The shown microwave assembly is a multiple-input and multiple-output (MIMO) radio device.

The antenna 3 and the adapter device 1, form, in combination, an antenna assembly which is realized by a stack of coplanar layers of exemplarily identical rectangular footprint, while the printed circuit board 2 has exemplarily smaller rectangular footprint. By way of example, the antenna 3 is itself realized by a stack of four coplanar layers. Layer 3*d* is the adapter facing outer antenna layer to which the adapter device 1 attached e. g. via adhesive bonding or is screwed together with a set of screws. Layer 3*a* is an adjacent outer antenna layer and comprises e. g. horn-shaped waveguide openings 34 for transmitting and/or receiving electromagnetic waves, in particular microwaves on an outer surface 30*a* of the antenna 3. Layers 3*b* and 3*c* are intermediate layers and comprise a waveguide transmission and/or distribution structure (not visible).

Figure 4:
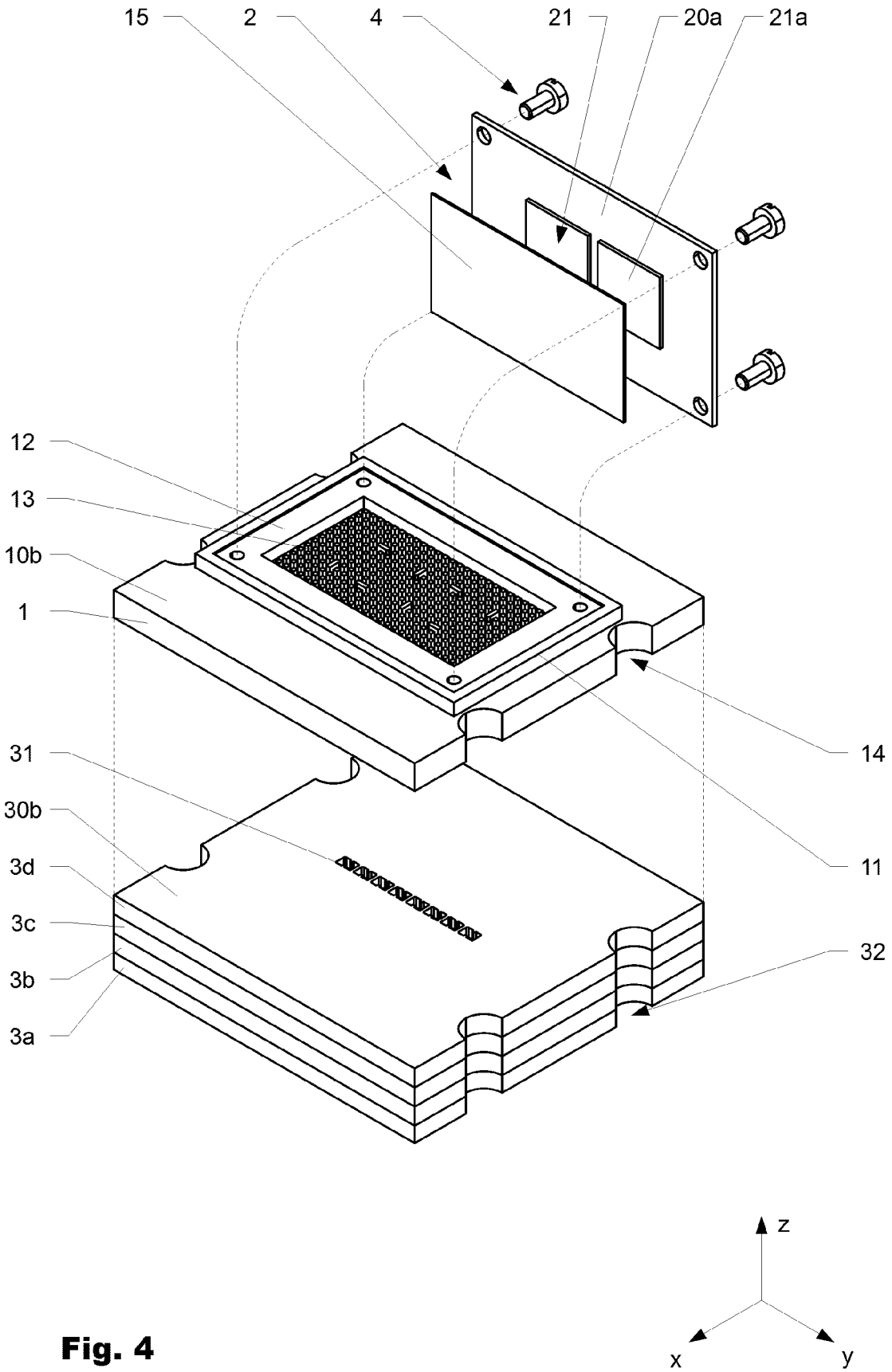
FIG. 4 shows the microwave assembly in a partly exploded perspective view.

In the following, reference is additionally made to FIG. 4, showing the microwave assembly in a perspective and partially exploded view.

On the antenna-opposing adapter surface 10*b*, the adapter device 1 comprises a circumferential alignment ridge 11 that enclosed area of which receives the printed circuit board 2 with tight tolerance. A planar circumferential printed circuit board coupling surface 12 provides a supporting surface for a corresponding counter-surface of the adapter-facing printed circuit board surface 20*a*.

The printed circuit board coupling surface 12 surrounds the component-receiving recess 13 in which a band-gap structure is arranged (not referenced in FIG. 4). The ground of the component receiving recess 13 (in z-direction) is the recess ground 13*b*.

Exemplarily two microwave semiconductor components 21 are mounted on the adapter-facing printed circuit board surface 20*a* such that they are, in an assembled state, received by the component-receiving recess 13. A total number of exemplarily eight component waveguide coupling elements (not visible in detail) are arranged on the adapter-facing surface 21*a* of the two microwave semiconductor components 21. The printed circuit board is mounted to the adapter device 1 via exemplarily four screws 4.

The distance by which the microwave semiconductor components 21 raise above the adapter-facing printed circuited board surface 20*a*, the distance by which the band gap elements project into the component-receiving recess, and the printed circuit board coupling surface 12 are dimensioned such that a defined gap is present between the adapter-facing component surfaces 21*a* of the two microwave semiconductor components 21 and the component-facing ends of the band gap elements, which is bridged by an optional sheet-like coupling member 15.

On the adapter-facing antenna surface 30*b*, a number of exemplarily double-ridged antenna waveguide coupling openings 31 is arranged in a row, with each antenna waveguide coupling opening being in a one-to-one correspondence with a waveguide coupling element of one of the microwave semiconductor components 21. The single antenna waveguide coupling openings 31 are exemplarily equally spaced apart.

Alignment recesses 32 are present in the circumferential edge of each of the antenna layers 3*a*, 3*b*, 3*c*, 3*d*. Exemplarily, the alignment recesses have the contour of a concave cylinder jacket section. Corresponding alignment recesses 14 are also present in the circumferential edge of the adapter device 1. The alignment recesses 32, 14 form, in combination, a concave cylinder jacket for alignment with external alignment members, such as alignment posts or alignment pins (not shown) during manufacture of the antenna assembly.

Figure 5:
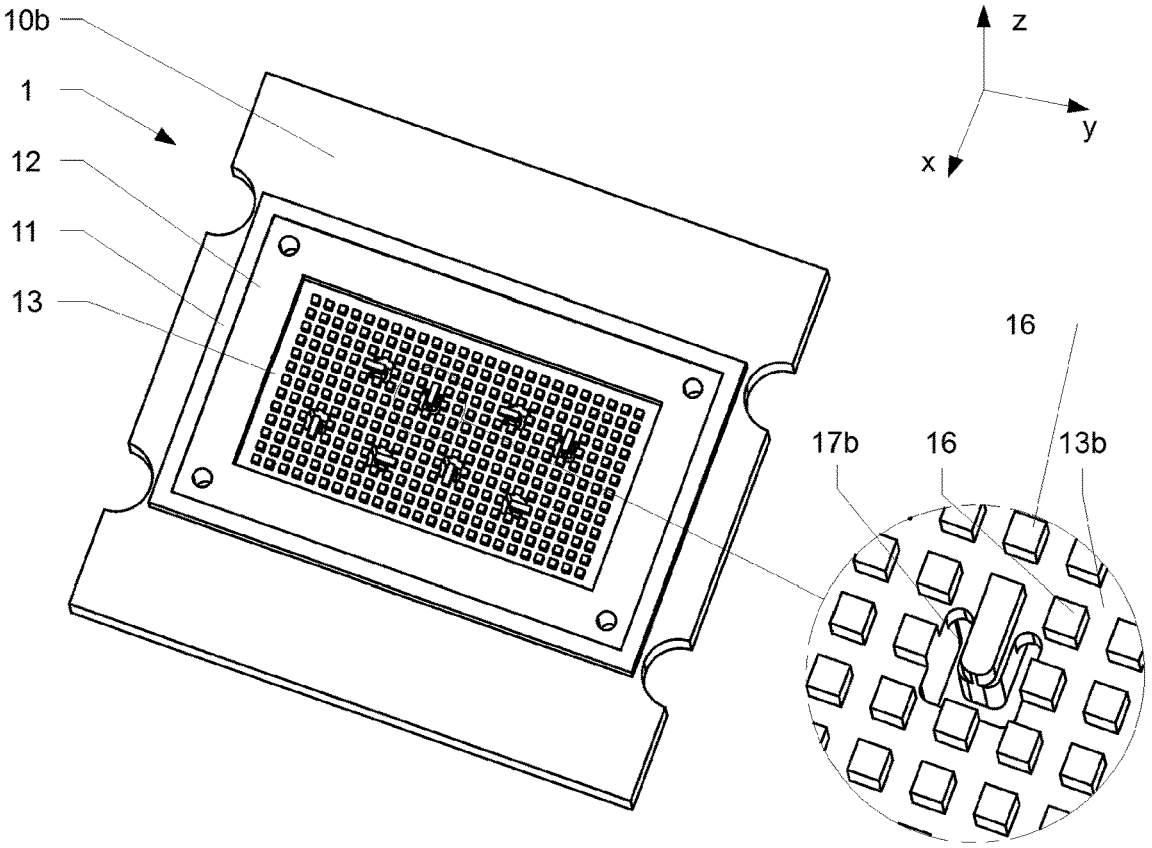
FIG. 5 shows an embodiment of an adapter device in a perspective top view.

In the following, reference is additionally made to FIG. 5, showing an exemplary embodiment of the adapter device 1 in a perspective top view, together with a detailed view of a section of the component receiving recess.

The band gap structure is realised by a regular pattern of band gap elements 16 in form of square-sectioned posts that project from the recess ground 13*b* perpendicularly into the component-receiving recess 13. In a typical exemplary embodiments, the band gap elements 16 have a square footprint of (0.6×0.6) $mm^2$, project into the component receiving recess 13 by a height of one mm (z-direction) and are laterally spaced apart (x- and y-direction) by 0.6 mm.

The U-shaped component-facing channel openings 17*b* of the single-ridged adapter waveguide channels 17 are arranged between the band gap elements 16. Each of the component-facing channel openings 17*b* is, in the assembled state, aligned (in z-direction) with a corresponding component waveguide coupling element. As best seen in the detailed view, a band gap element 16 continues as ridge into the adapter waveguide channel 17.

Figure 7:
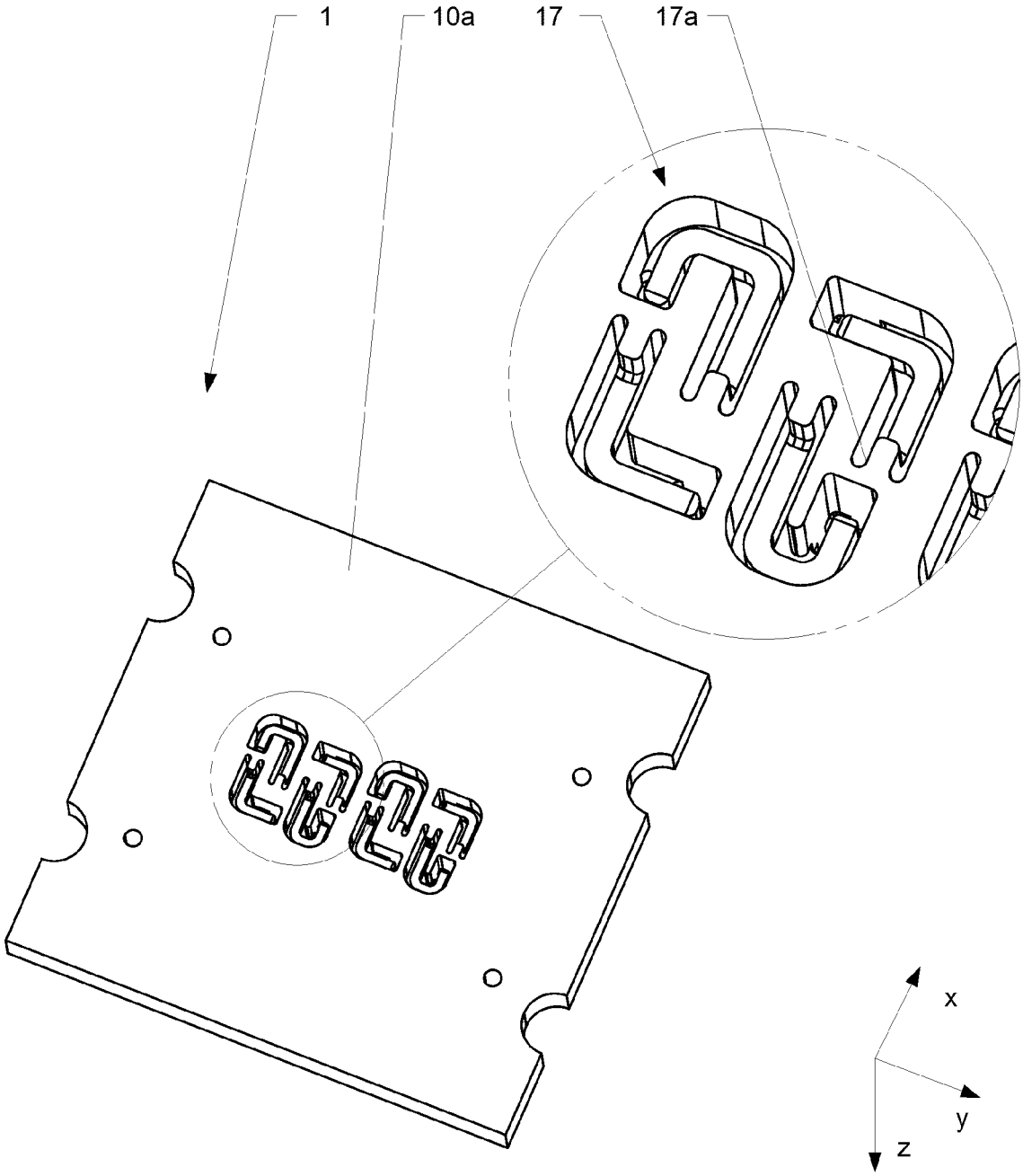
FIG. 7 shows an embodiment of an adapter device in a perspective bottom view.

In the following, reference is additionally made to FIG. 7, showing the adapter device in a perspective bottom view. Exemplarily eight U-shaped antenna-facing channel openings 17*a* are provided on the antenna facing adapter surface 10*a*. The antenna-facing channel openings 17*a* are aligned in a row such that each antenna-facing channel opening is, in an assembled state, aligned with a corresponding antenna waveguide coupling opening 31. Each pair of an antenna-facing channel opening 17*a* and a component-facing channel opening 17*b* form the ends of a corresponding single-ridged adapter waveguide channel 17.

As further visible from FIG. 7, the single-ridged adapter waveguide channels 17 have a section that runs parallel to the antenna-facing adapter surface 10*a* and is further open to the antenna-facing adapter surface 10*a*, with the antenna-facing channel opening 17*a* forming an end section of the single-ridged adapter waveguide channel 17. In an assembled state, the open section of the adapter waveguide channel is, with exception of the antenna-facing channel opening 17*a*, covered by the adapter-facing antenna-surface 30*b*.

As best visible from FIG. 5 and FIG. 7 in combination, the geometric pattern of the component-facing channel openings 17*b* (identical to the geometric pattern of the component waveguide coupling elements) is different from the geometric pattern of the antenna-facing channel openings 17*a* (identical to the geometric pattern of the antenna waveguide coupling openings 31). The curved adapter waveguide channels accordingly form a distribution structure. The single-ridged adapter waveguide channels 17 are further individually optimized for identical wave guiding characteristics respectively microwave transmission characteristics and in particular an identical electrical length. Since the electrical length of the adapter waveguide channels 17 depends on both on their physical/geometrical length and cross section, the physical length and/or the cross sections, e. g. the cross section over a section of the physical length, may be tuned or modified for this purpose.

As best visible in FIG. 7, the single-ridged adapter waveguide channels 17 form a three-dimensional (spatial) curve that is different for different adapter waveguide channels in dependence of the position of the corresponding antenna-facing channel opening 17*a* and component-facing channel opening 17*b*.

Figure 6:
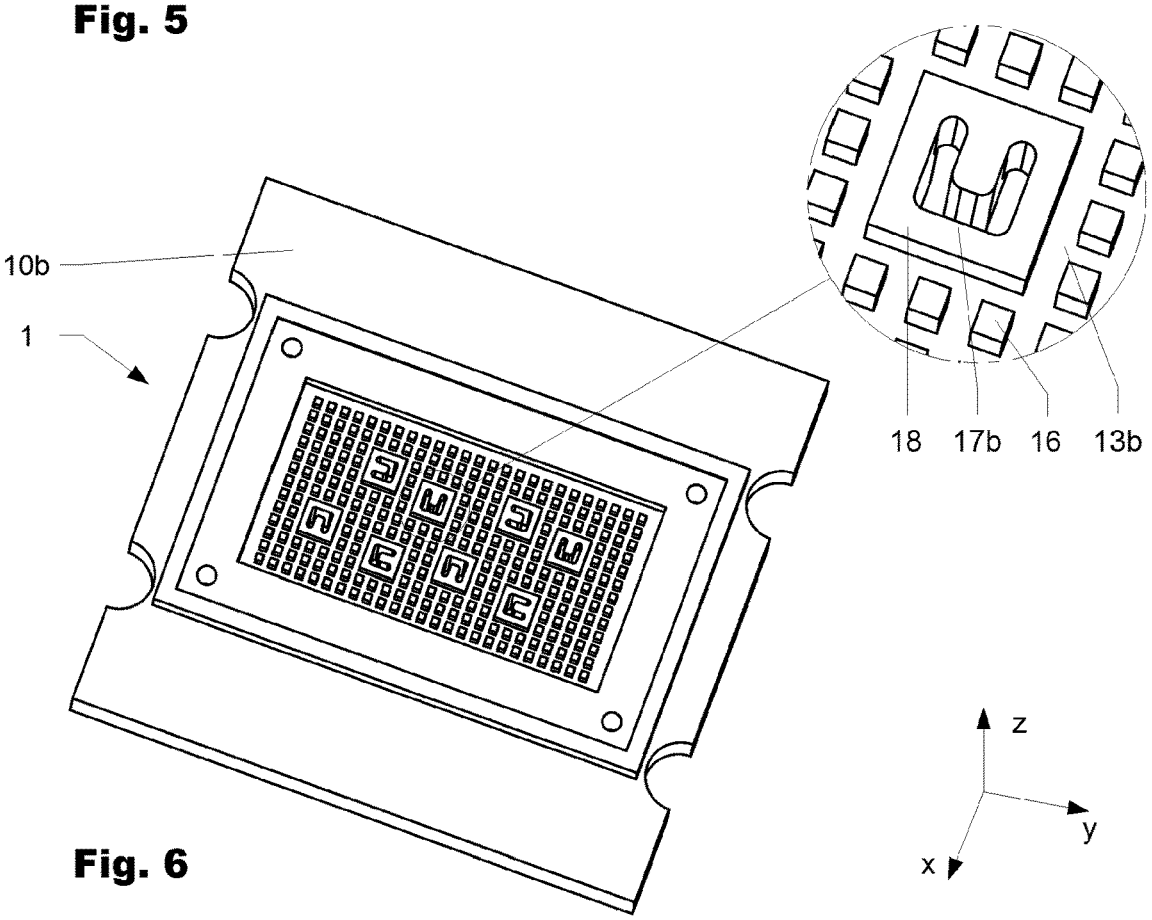
FIG. 6 shows a further embodiment of the adapter device in a perspective top view.

In the following, reference is additionally made to FIG. 6, showing a further exemplary embodiment of the adapter device 1 in view corresponding to FIG. 5, with the bottom view being substantially the same as shown in FIG. 7. Since this embodiment is similar to the before-described embodiments in a number of aspects, only differences are discussed in the following.

The component-facing channel openings 17*b* of this embodiment are arranged in channel posts 18 of exemplarily square cross section that project, like the band gap elements 16, in z-direction from the recess ground 13*b* by the same height as the band gap elements 16. The component-facing channel openings 17*b* accordingly lay in a common plane with the component-facing end surfaces of the band gap elements 16. A component-sided straight end section of each single-ridged adapter waveguide channel 17 is arranged inside the channel posts and in parallel alignment with the channel post 18.

Figure 8:
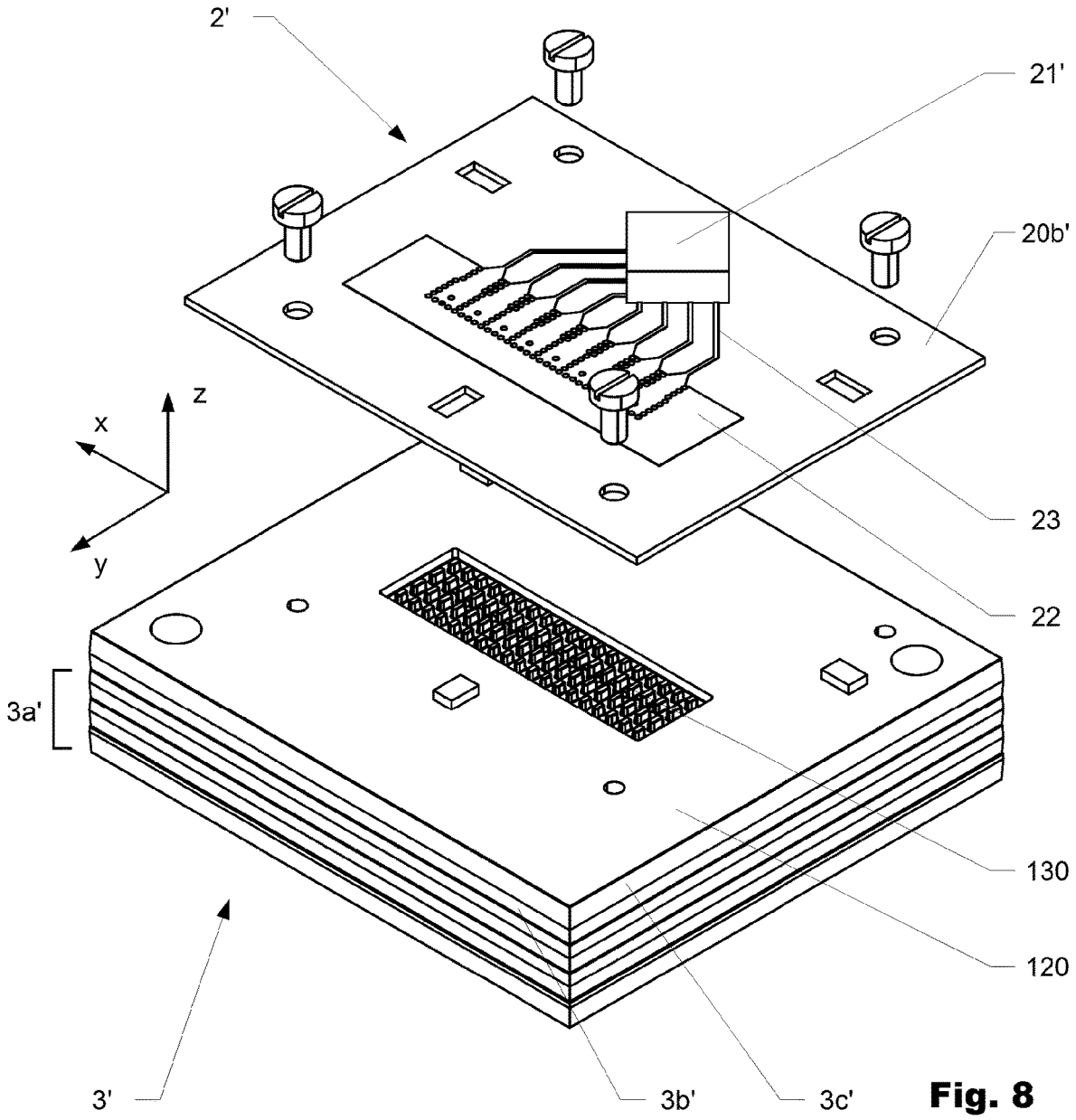
FIG. 8 shows a further embodiment of a microwave assembly with an antenna and a printed circuit board.

In the following, reference is made to FIG. 8 to FIG. 13, showing a further microwave assembly. FIG. 8 shows a PCB 2' together with an antenna 3' in a partly exploded perspective bottom view. The antenna 3' is made from a stack of a number of coplanar layers as generally explained before. For the sake of conciseness and clarity, only the bottom layer 3*c*' that contacts the PCB 2' and the next following layer 3'*b* are individually referenced. All further layers are, in combination, referenced as 3*a'*.

The bottom layer 3*c*' that is arranged between the PCB 2' and the other layers 3*b*, 3*a*' is realized as adapter structure. Surface 120 of the bottom layer 3*c*' is a peripheral surface that serves as printed circuit board coupling surface. The bottom layer 3*c*' further forms the adapter body.

The PCB 2' has an integrated microwave structure for coupling the microwave semiconductor component to the antenna 3'. In FIG. 8, a metallization 22 is visible from which microstrip lines 23 extend to the microwave semiconductor component 21*a* for signal coupling. The design of the PCB 2' is discussed in more detail further below.

A microwave semiconductor 21' is mounted on the PCB 2'. In contrast to the before-described embodiments, the microwave semiconductor 21' is arranged in the antenna-opposing PCB surface 20*b*', facing away from the antenna 3'.

Figure 9:
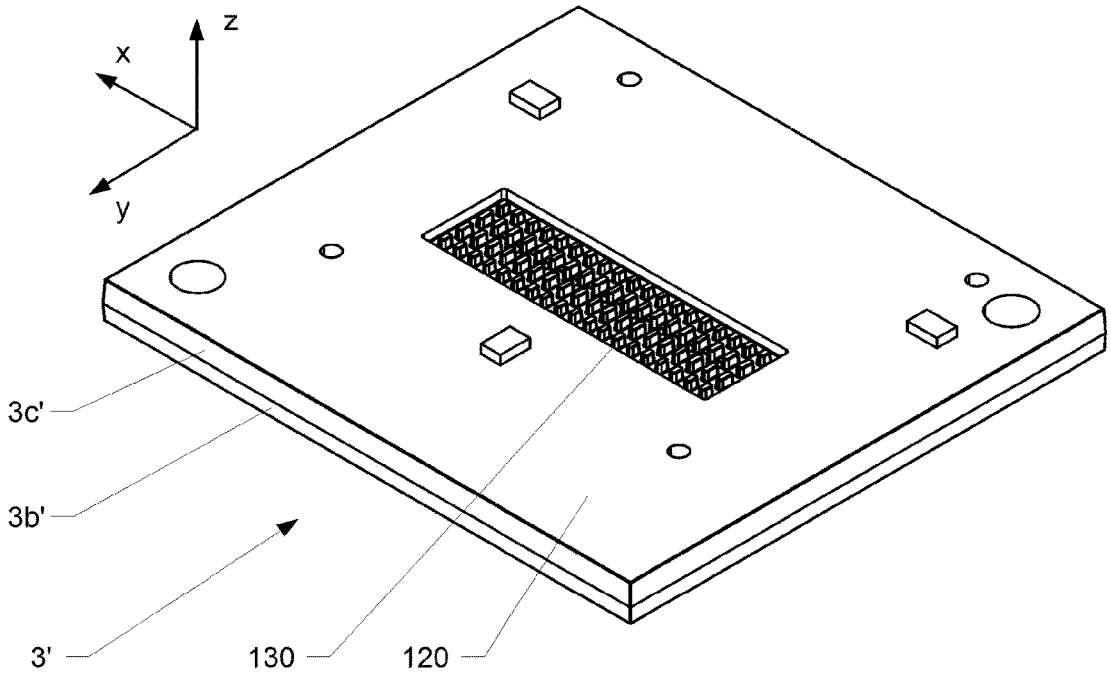
FIG. 9 shows part of the antenna of the embodiment of FIG. 8 in a perspective view.
Figure 10:
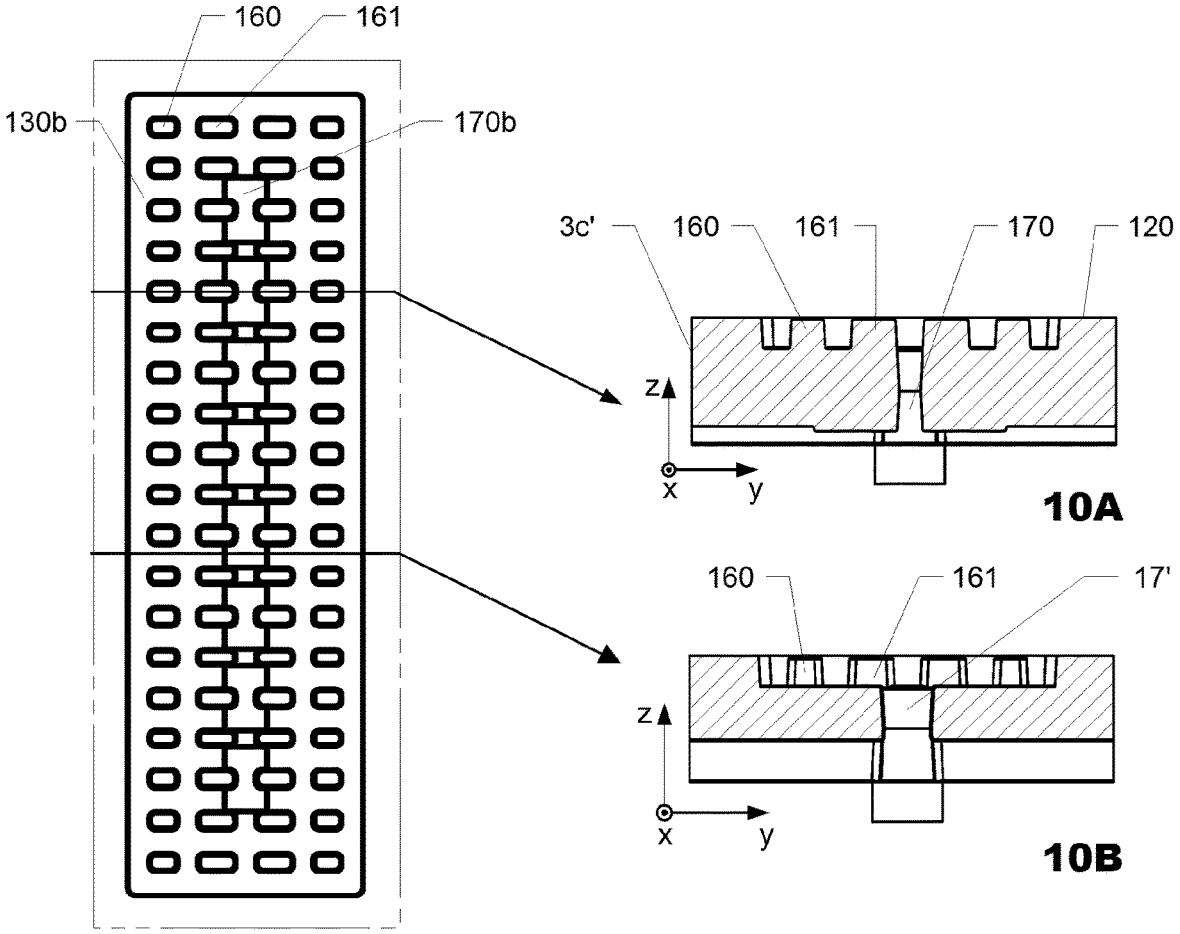
FIG. 10 shows the recess with electromagnetic band gap structure of the embodiment of FIG. 8.

FIG. 9 shows the two bottom-most layers 3*b*', 3*c*' in a perspective bottom view. FIG. 10 shows a detailed top view of recess 130 in bottom layer respectively adapter body 3*c*'. Band gap elements 160, 161 project from the recess ground 130*b*. H-shaped component-facing channel openings 170*b* are arranged in the recess ground 130*b* along a straight line. The band gap elements 160, 161 are arranged in a pattern of rows and columns, respectively as matrix, with the center line of the component-facing waveguide openings being symmetric with respect to two neighboring rows of band gap elements 160, 161. In this way, electromagnetic sealing is achieved.

It can be seen that between each pair of neighboring component-facing channel openings 170, there is a further column of band gap elements 160, 161. Further, these band gap elements are flush with edges of the component-facing channel openings, i. e. the distance between the edges of two neighboring component-facing channel openings 170*b* along the direction of the rows corresponds to the width of the band gap elements 161 in between them.

FIG. 10A, 10B are cross-sectional views through adapter waveguide channels 170 as indicated in FIG. 10. It can be seen that band gap elements 161 are arranged as continuous extensions of the ridges with a smooth transition. As further visible in FIG. 10, there is a further continuous and uninterrupted row of band gap elements 160 on both sides of the two rows of band gap elements 161. In FIG. 10A, 10B it can be further seen that that the band gap elements 160, 161 stand slightly back behind the printed circuit board coupling surface 120.

Figure 11:
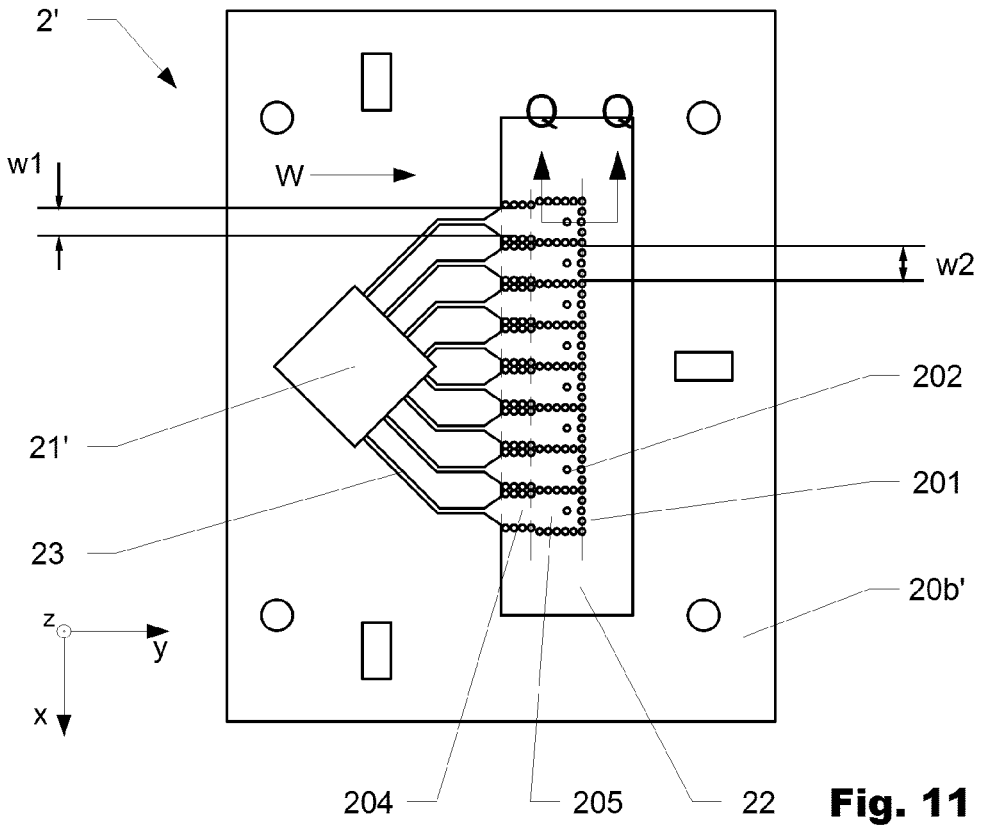
FIG. 11 shows the antenna-opposing side of the printed circuit board of the embodiment of FIG. 8.
Figure 12:
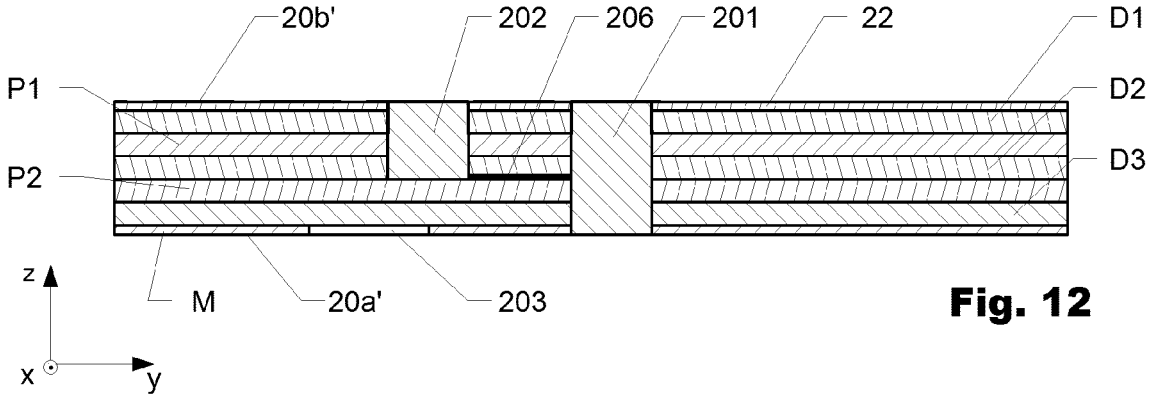
FIG. 12 shows a cross sectional view of the printed circuit board of the embodiment of FIG. 8.
Figure 13:
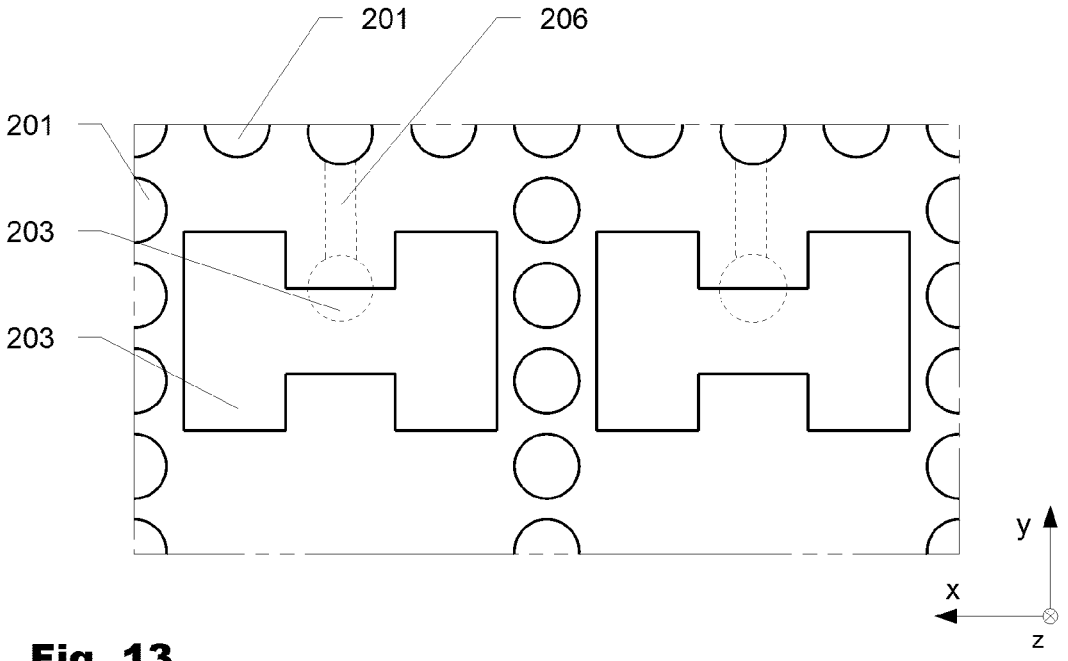
FIG. 13 shows detail of the antenna-facing side of the printed circuit board of the embodiment of FIG. 8.

FIG. 11 and FIG. 13 show a view onto the antenna-opposing PCB surface 20*b*' and the antenna-facing PCB surface 20*a*', respectively. FIG. 12 is a cross-sectional view along line Q-Q as indicated in FIG. 11.

The PCB 2' is a sandwich from three dielectric layers D1, D2, D3 that are separated by prepreg (preimpregnated fibres) layers P1, P2. The outer surface of the first dielectric layer D1 forms the antenna-opposing PCB surface 20*b*' and the outer surface of the third dielectric layer D3 forms the antenna-facing PCB surface 20*a*'. The outer surfaces of the first dielectric layer D1 and the third dielectric layer D3 are generally metalized. On the antenna-opposing PCB-surface 20*b*', however, the metallization is partly removed to form metallization 22 with microstrip lines 23 as visible in FIGS. 8, 11. Exemplarily eight microstrip lines 23 (exemplarily aligned with the y-direction) are present, corresponding to eight inputs/outputs of the microwave semiconductor component 21'. The inner surfaces of the dielectric layer D1, D2, D3 are generally non-metallized within the SIW waveguide channels with the exception of connection strips 206 as explained further below. Outside the SIW channels the inner layers can be metalized in order to act as low frequency signals or power distribution layers for the microwave semiconductor component 21'. The outer metallization of the antenna-facing PCB-surface 20*a*' is referenced as M in FIG. 12. It is noted that the use of microstrips is not essential, but that other type of wave-guiding structures, such as coplanar waveguides or striplines could be used as well.

Adjacent to the microstrip lines 23, substrate integrated waveguides (SIWs) are arranged. There are microstrip to SIW transitions 22*a* which couple microstrip lines 23 to the corresponding SIW waveguides 204. Such transitions are known in the art (see, e.g. D. Deslandes, "Design equations for tapered microstrip-to-Substrate Integrated Waveguide transitions," 2010 IEEE MTT-S International Microwave Symposium, Anaheim, Calif., 2010, pp. 704-707.). Traverse to the direction of wave propagation W (exemplarily corresponding to the y-direction), the single SIWs are delimited and separated from each other by an arrangement of through-going vias 201 that extend in parallel lines, parallel to the direction of wave propagation inside the SIWs. The arrangement of through-going vias 201 separates each SIW in two sections that are adjacent to each other in the direction of wave propagation W. In a first SIW section 204, each SIW is delimited traverse to direction of the SIWs by a separate line (exemplarily aligned with the y-direction) of through-going vias 201, resulting in pairs of through-going vias 201 in a side-by-side arrangement between neighboring first SIW sections 204.

Adjacent to the first SIW section 204, there is, for each SIW, a second SIW section 205. The second SIW sections 205 are separated from each other by single lines of through-going vias 201 that are arranged in line with the center lines of the pairs of through-going vias 201 for the first SIW sections 204. Neighbouring second SIW sections 205 accordingly share a common line of through-going vias 201 that is arranged between them (exemplarily aligned with y-direction FIG. 11). Thereby, the second SIW sections 205 have a width w2 that is wider than w1. The second SIW sections 205 are delimited traverse to the direction of wave propagation by a continuous line of through-going vias 201 (exemplarily aligned with x-direction FIG. 11). At least in the area of the first SIW sections 204 and second SIW sections 205, all inner metalizations of the dielectric layers D1, D2, D3 are removed in the relevant area with the exception of connection strips 206 as explained further below.

As best visible in FIG. 12, the through-going vias 201 bridge all layers D1, P1, D2, P2, D3 and connect the metallization 22 on the antenna-opposing PCB surface 20*b*' with the metallization M of antenna-facing PCB surface 20*a*. Thereby, the whole thickness of the PCB 21' serves as SIW It further noted that the through-going vias 201 (like the blind vias 202 as discussed further below) are shown as solid cylinders in FIG. 12 in the interest of a clear drawing).

As best visible in FIG. 13, H-shaped PCB waveguide coupling apertures 203 are arranged on the third dielectric layer D3 that are realized by a corresponding partial H-shaped removal of the metallization M. In an assembled configuration of the PCB 2' and the antenna 3', each of the PCB waveguide coupling apertures 203 is aligned with a corresponding component-facing channel opening 17*b*.

As best visible from FIG. 11, FIG. 12, and FIG. 13, a blind via 202 is further present for each of the second SIW sections 205. The blind vias 202 extend from the antenna-opposing PCB surface 20*b*' like the through-going vias 201. In contrast to the through-going vias 201, however, they do not bridge all layers of the PCB. Instead, they extend only through the first dielectric layer D1, the first prepreg layer P1 and the second dielectric layer D2. While the metallization of the inner layers is generally removed as explained before, the blind ends of the blind vias 202 are galvanically connected by way of a connection strip 206 of remaining metallization on the antenna-facing side of the dielectric layer D2, with a through-going via 201. The connection strip 206 is arranged on the surface of the second dielectric layer D2 that points towards the antenna-facing PCB surface 20*a*' and runs parallel to the extension direction of the second SIW section 205 (direction W of wave propagation). Thereby, it connects the ground or blind end of the blind via 202 with an associated through-going via 201 of the line of through-going vias 201 that delimit the second SIW sections 205 traverse to the direction of wave propagation W.

As best visible in FIG. 13, each blind via 202 is laterally positioned such that its center is aligned with the second SIW section 205 and the PCB waveguide coupling aperture 203 in the direction of the width of the waveguide apertures 205 (traverse to the direction of wave propagation W). In direction of the wave propagation W, half of the blind via 202 lies within the area of the PCB waveguide coupling aperture 203, while the other half lies under the metallization M, towards the line of through-going vias 201 that delimit the second SIW sections 205 traverse to the direction of wave propagation W.

The arrangement of second SIW sections 205 (both delimited by through-going vias 201), blind vias 202 and waveguide-coupling apertures 203 forms a waveguide coupling structure that deflect the electromagnetic waves from the wave propagation direction W (tangential to the PCB 2') by 90 degrees such that they enter and/or exit the waveguide coupling openings 203 traverse to the PCB 2'. Further, the arrangement serves for impedance matching between the SIW sections 204 and 205 and the adapter waveguide channels 170.

The purpose of blind via 202 is to deflect the electric field direction from perpendicular to the propagation direction W to a direction more tangential to the PCB waveguide coupling aperture 203. In this way, the coupling between second SIW section 205 and adapter waveguide channel 170 is improved.

The distance between the centre of a PCB waveguide coupling aperture 203 and the end of the associated second SIW section 205 as defined by the line of through-going vias 201 perpendicular to the direction of wave propagation W is favourably selected to be about a quarter of a guided wavelength (inside the second SIW section) at the central frequency of operation, thereby transforms a short at the end of the second SIW section into open load at the plane of the PCB waveguide coupling aperture and maximizing the electric field at this plane which increases the coupling between PCB 2' and the antenna layer 3*c*'.

The width w1 of the first SIW section 204 is favourably selected, for a main frequency of operation of the system, such that it lies above the cut-off frequency of the first mode and below the cut-off frequency of the second mode.

The width 22 of the second SIW section 205 is favourably selected slightly larger than the width w1 SIW in order to accommodate the PCB waveguide coupling aperture 203.

The length of the second SIW section 205 (along the direction of wave propagation W) is favourably selected sufficiently long to accommodate the PCB waveguide coupling aperture 203 and a quarter guided wavelength distance between the end of the second SIW section 205 and the centre of the PCB waveguide coupling aperture 203. Favourable the total length of the second SIW section 205 should be least half of guided wavelength or more. It is noted that tuning of this dimension is critical since it is constrained by the fact that the number of vias is necessarily an integral number.

The footprint of the PCB waveguide coupling aperture 203 is generally similar to the footprint of the associated component facing channel opening 17*b*. It may be favourably tuned by way of numerical optimization. The width of the via connecting strip is also tuned by way of numerical optimization.

REFERENCE SIGNS

1 adapter device
2, 2' printed circuit board (PCB)
3, 3' antenna
3*a*, 3*b*, 3*c*, 3*d* antenna layer
3*a*', 3*b*', 3*c*' antenna layers
4 screw
10*a* antenna-facing adapter surface
10*b* antenna-opposing adapter surface
11 alignment ridge
12, 120 printed circuit board coupling surface
13 component-receiving recess
13*b* recess ground
14 alignment recess
15 coupling member
16, 160, 161 band gap element
17 single-ridged adapter waveguide channel
17*a* antenna-facing channel opening
17*b* component-facing channel opening
18 channel post
20*a* adapter-facing PCB surface
20*b*' antenna-opposing PCB surface
20*a*' antenna-facing PCB surface
21, 21' microwave semiconductor component

21*a* adapter-facing component surface
22 metallization
23 microstrip line
30*a* outer surface/top surface of antenna
30*b* adapter-facing antenna surface
31 antenna waveguide coupling opening
32 alignment recess
34 waveguide opening
130 recess
130*b* recess ground/base surface
170 double-ridged adapter waveguide channel
201 through-going via
202 blind via
203 PCB waveguide coupling aperture
204 first SIW section
205 second SIW section
206 connection strip
D1, D2, D3 dielectric layers
M metallization
P1, P2 prepreg layers
W direction of wave propagation in SIWs
w1 First SIW section width
w2 second SIW section width

The invention claimed is:

1. An adapter structure for transferring an electromagnetic signal between an electronic component (2') and an antenna (3'), the adapter structure comprising:

an adapter body (3*c*') having a base surface (130*b*);

at least one ridged adapter waveguide channel (170), wherein the at least one adapter waveguide channel (170) extends from the base surface (130*b*) into the adapter body (3*c*');

an electromagnetic band gap structure with a plurality of band gap elements, wherein the band gap elements (160, 161) are spaced apart relative to each other, project from the base surface (130*b*) and have a front face spaced apart from the base surface (130*b*);

wherein at least one band gap element (161) is arranged as an extension of a ridge of the at least one adapter waveguide channel (170).

2. The adapter structure according to claim 1, wherein the at least one adapter waveguide channel (170) is double-ridged.

3. The adapter structure according to claim 2, wherein two band gap elements (161) are arranged as extensions of the two ridges of the at least one adapter waveguide channel (170).

4. The adapter structure according to claim 1, comprising a plurality of adapter waveguide channels (170), wherein for each of the adapter waveguide channels (170) at least one band gap element (161) is arranged as extension of a ridge of the associated waveguide channel (170).

5. The adapter structure according to claim 4, wherein the adapter waveguide channels (170) are of substantially identical electrical length.

6. The adapter structure according to claim 4, wherein the plurality of adapter waveguide channels (170) forms a distribution structure.

7. The adapter structure according to claim 1, wherein the at least one adapter waveguide channel is curved.

8. The adapter structure according to claim 1, wherein the adapter structure is made from injected-moulded plastics.

9. The adapter structure according to claim 1, wherein the adapter structure includes a printed circuit board alignment structure for mutually aligning the adapter structure with a printed circuit board (2') and/or an antenna alignment structure for mutually aligning the adapter structure with the antenna (3').

10. The adapter structure according to claim 1, wherein the base surface (130*b*) is, in an area of the electromagnetic band gap structure, planar with exception of the band gap elements (160, 161).

11. The adapter structure according to claim 1, wherein the adapter structure is an adapter device (1) for transferring a microwave signal between a component waveguide coupling structure of an electronic component, in particular a microwave semiconductor component (21) mounted on a printed circuit board (2), and an antenna waveguide coupling structure of the antenna (3), the adapter structure further including:

an antenna-facing adapter surface (10*a*);

an antenna-opposing adapter surface (10*b*), the antenna-opposing adapter surface (10*b*) being spaced apart from the antenna-facing adapter surface (10*a*);

wherein the antenna-opposing adapter surface (10*b*) has a component-receiving recess (13), the component-receiving recess (13) being dimensioned to receive at least part of the microwave semiconductor component (21) and the component-receiving recess (13) having a recess ground (13*b*) that defines the base surface;

wherein the at least one adapter waveguide channel (17) extends in the adapter body between the recess ground (13*b*) and the antenna-facing adapter surface (10*a*).

12. The adapter structure according to claim 11, including a printed circuit board mounting structure, the printed circuit board mounting structure being arranged on the antenna-opposing adapter surface (10*b*).

13. An antenna (3') comprising an adapter structure according to claim 1, the antenna (3') having a top surface with at least one waveguide opening (34) for transmitting and/or receiving electromagnetic signals, wherein the at least one waveguide opening (34) is operatively connected with the at least one adapter waveguide channel (170).

14. A microwave assembly, including an antenna (3') according to claim 13 and a printed circuit board (2'), the printed circuit board having an antenna-facing PCB surface (20*a*') with at least one waveguide coupling aperture (203), wherein the front faces of the band gap elements (160, 161) face the antenna-facing PCB surface (20*a*') and the at least one waveguide coupling aperture (203) is aligned and operatively connected with the at least one adapter waveguide channel (170).

15. A method for transmitting at least one electromagnetic signal, in particular a microwave signal, the method including transmitting the at least one electromagnetic signal via an adapter structure according to claim 1.

* * * * *